US007921497B2

(12) United States Patent
Cook et al.

(10) Patent No.: US 7,921,497 B2
(45) Date of Patent: Apr. 12, 2011

(54) CARPET STAIN REMOVAL DEVICE

(75) Inventors: Stephen B. Cook, Appleton, WI (US); Brian James Ludka, Neenah, WI (US); Gregory J. Rajala, Neenah, WI (US); Carl Gerard Rippl, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1221 days.

(21) Appl. No.: 11/529,738

(22) Filed: Sep. 28, 2006

(65) Prior Publication Data

US 2008/0078042 A1 Apr. 3, 2008

(51) Int. Cl.
*A47L 11/282* (2006.01)

(52) U.S. Cl. ..... 15/98; 15/50.3; 15/52.1

(58) Field of Classification Search ..... 15/23, 27, 15/48.1, 50.3, 52.1, 98; *A47L 11/282*
See application file for complete search history.

(56) References Cited

U.S. PATENT DOCUMENTS

| | | | | |
|---|---|---|---|---|
| 21,815 | A | 10/1858 | Carey | |
| 212,727 | A * | 2/1879 | Moore | 15/41.1 |
| 748,560 | A * | 12/1903 | Reenstierna | 15/41.1 |
| 901,978 | A | 10/1908 | Mally et al. | |
| 1,395,500 | A | 11/1921 | Kirby | |
| 2,783,487 | A | 2/1953 | Luders | |
| 3,378,871 | A | 4/1968 | Suleski | |
| 3,631,558 | A | 1/1972 | Kovacevic | |
| 3,638,267 | A | 2/1972 | Liebscher | |
| 3,696,458 | A | 10/1972 | Leifheit et al. | |
| 3,742,547 | A | 7/1973 | Sohmer | |
| 4,279,057 | A | 7/1981 | Restivo | |
| 5,239,721 | A * | 8/1993 | Zahuranec | 15/41.1 |
| 5,343,587 | A | 9/1994 | Findley | |
| 5,533,223 | A | 7/1996 | Ho | |
| 5,697,119 | A | 12/1997 | Mussalo | |
| 6,041,463 | A * | 3/2000 | Stauch | 15/52.1 |
| 6,551,001 | B2 | 4/2003 | Aberegg et al. | |
| 7,022,003 | B1 | 4/2006 | Hughes | |
| 2004/0034952 | A1 * | 2/2004 | Ho et al. | 15/48.1 |

FOREIGN PATENT DOCUMENTS

| | | |
|---|---|---|
| DE | 209876 | 9/1907 |
| DE | 29613740 | 9/1996 |
| EP | 1442693 | 8/2004 |
| GB | 670905 | 4/1968 |

OTHER PUBLICATIONS

PCT Search Report for PCT/IB2007/053239.

* cited by examiner

*Primary Examiner* — Monica S Carter
*Assistant Examiner* — Stephanie Newton
(74) *Attorney, Agent, or Firm* — Dority & Manning, P.A.

(57) ABSTRACT

A floor scrubbing apparatus that is particularly well suited to scrubbing carpet materials is disclosed. The floor scrubbing apparatus is manually operated and includes a drive roller coupled to a scrub roller. In one embodiment, the drive roller is coupled to the scrub roller using a gear arrangement that causes the scrub roller to rotate faster than the drive roller. If desired, the apparatus can include a cleaning fluid dispensing system. For instance, the apparatus can include one or more nozzles that dispense a cleaning fluid onto a carpet material as the material is being cleaned.

16 Claims, 7 Drawing Sheets

CARPET STAIN REMOVAL DEVICE

BACKGROUND OF THE INVENTION

In the recent past, great advances have been made in developing stain-resistant carpets and in developing cleaning solutions capable of removing stains from carpets without damaging the underlying material.

Still, improvements are needed in the manner in which carpets are cleaned. For example, carpet cleaning in most households involves a full carpet cleaning in which a homeowner either hires a professional or rents industrial equipment in order to complete the task. Otherwise, carpets are typically spot cleaned using a carpet cleaning fluid that is sprayed onto the carpet and then scrubbed using a rag or other similar scrubbing tool. Spot cleaning, however, can be a tedious process that often requires a person to gather several cleaning items and kneel and scrub over the spill. Unless gloves are worn, the hands of the user may be exposed to the harsh cleaning solutions. Also, the user typically has to get relatively close to the area being scrubbed, which can lead to the inhalation of fumes given off by the cleaning solution. Further, many carpets can become damaged should the carpet be scrubbed using too much force and/or scrubbed in an irregular motion.

Thus, a need currently exists for an improved carpet cleaning device or apparatus that is capable of cleaning stains and spills that may be present on a carpet.

SUMMARY OF THE INVENTION

In general, the present disclosure is directed to a floor scrubbing apparatus that is particularly well suited to scrubbing carpets. For instance, the apparatus of the present disclosure is well suited to spot-cleaning carpets.

In one embodiment, for instance, the floor scrubbing apparatus includes a handle connected to a rotating roller arrangement. The roller arrangement may include a drive roller in operative association with a scrub roller. The drive roller and scrub roller, for instance, can be positioned adjacent to one another substantially along a common axis.

The drive roller can be coupled to the scrub roller such that the drive roller drives the scrub roller as the drive roller is rotated. For instance, in one embodiment, a gear arrangement may connect the drive roller to the scrub roller. The gear arrangement may be further configured to rotate the scrub roller at a faster rate than the drive roller. For instance, the scrub roller may rotate at a speed that is twice as fast or three times as fast as the rotational speed of the drive roller. This speed differential allows the carpet or other surface to be scrubbed as the drive roller moves along the surface.

The gear arrangement, in one embodiment, may comprise a planetary gear set. The planetary gear set may comprise a stationary ring gear, a sun gear and a plurality of planet gears positioned in between the sun gear and the ring gear. The drive roller may cause the planet gears to rotate around the ring gear when the drive roller is rotated causing the sun gear to rotate. The sun gear, in turn, may cause the scrub roller to rotate.

In addition to the gear arrangement, the floor scrubbing apparatus may also include a clutch device that only permits the scrub roller to rotate when the drive roller is rotated in one direction. Thus, when the drive roller is moved in a back and forth motion, the scrub roller continues to rotate in a single direction. In this manner, the inertia of the scrub roller does not need to be overcome when the rotation of the drive roller is reversed.

In one embodiment, for instance, the clutch device may comprise a shaft or collar in communication with the scrub roller. The shaft may define a plurality of bearing engagement members. A plurality of bearing elements may be positioned along the outer circumference of the shaft. The bearing elements may be positioned between the shaft and a collar that is rotated by the gear arrangement. The clutch device may be configured such that, when the collar is rotated in a first direction, the bearing elements engage the bearing engagement members and cause the shaft to rotate. When the collar is rotated in an opposite direction, however, the bearing elements travel along the circumference of the shaft without rotating the shaft. Thus, the scrub roller may be configured to only rotate during a forward stroke of the drive roller. During a back stroke of the drive roller, on the other hand, the scrub roller is freewheeling. The freewheeling direction, however, may be reversed depending upon the orientation of the clutch device.

The handle included with the floor scrubbing apparatus can be attached to one end of the rotating roller arrangement or may branch off into a first tine and a second tine for attachment to each end of the roller arrangement. In one embodiment, the handle can have a length sufficient to allow a user to stand when scrubbing a carpet. For instance, the length of the handle can be greater than about 36 inches.

The floor scrubbing apparatus, if desired, can be used in conjunction with a cleaning fluid. In one embodiment, for instance, the apparatus may include at least one nozzle that is positioned to emit a cleaning fluid on or near the scrub roller. A reservoir may be placed in fluid communication with the nozzle. The reservoir is for holding a cleaning fluid and can be supported by the handle. In one particular embodiment, for instance, the handle may define an internal compartment that comprises the reservoir. For example, the handle can be hollow and cleaning fluid can be poured into the handle through an open end.

In order to emit a cleaning fluid from the nozzle, the floor scrubbing apparatus may include a user actuated pump. The pump may be in fluid communication with the nozzle and the reservoir for dispensing the cleaning fluid from the reservoir. The pump may be trigger actuated or, alternatively, can be battery operated.

In one embodiment, the drive roller may have a largest diameter that tapers to a smallest diameter. In this manner, the drive roller may maintain a relatively large surface area that remains in contact with the floor during use of the apparatus. In addition, a user can better adjust the amount of contact pressure that is exerted between the scrub roller and a carpet being cleaned. In one particular embodiment, for instance, the drive roller may include a middle portion spaced in between a first end portion and a second end portion. The middle portion may have a diameter greater than the first and second end portions. The drive roller may taper from the middle portion to each of the end portions.

In general, the scrub roller comprises a mandrel that is configured to receive a scrubbing sleeve or a scrubbing layer. The scrubbing sleeve or scrubbing layer may be configured to be disposed after use. In one embodiment, for instance, the floor scrubbing apparatus may be designed to receive a scrubbing sleeve that is made from a liquid absorbent and compressible material. For instance, the scrubbing sleeve may be made from a synthetic sponge-like material.

Alternatively, the scrub roller can include a sheet engaging device for engaging a planar scrubbing layer that is wrapped around the mandrel. The scrubbing layer may be, for instance, fixed into place by having its free ends inserted into a slot. Alternatively, the scrub roller can include a hook material that attaches to the scrubbing layer. In this embodiment, for instance, the scrubbing layer may be made from non-woven webs containing natural and/or synthetic fibers. The scrubbing layer may be supplied to the consumer already prewetted with a cleaning solution.

In still another embodiment of the present disclosure, the floor scrubbing apparatus may include a shifting device that is configured to move the scrub roller laterally in a back and forth motion as the scrub roller is rotated. A shifting device, for instance, may comprise an inner stationary shaft defining at least one channel. The channel may extend over at least a portion of the circumference of the shaft and include an S-like curve. The shifting device may further comprise a projecting member that is positioned within the channel on the shaft and connected to the scrub roller. As the scrub roller is rotated, the projecting member moves within the channel causing the scrub roller to move laterally in a back and forth motion. An accelerated forward scrubbing action, combined with a lateral side-to-side motion, provides a particularly effective method for working carpet fibers in all directions for effective stain removal.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
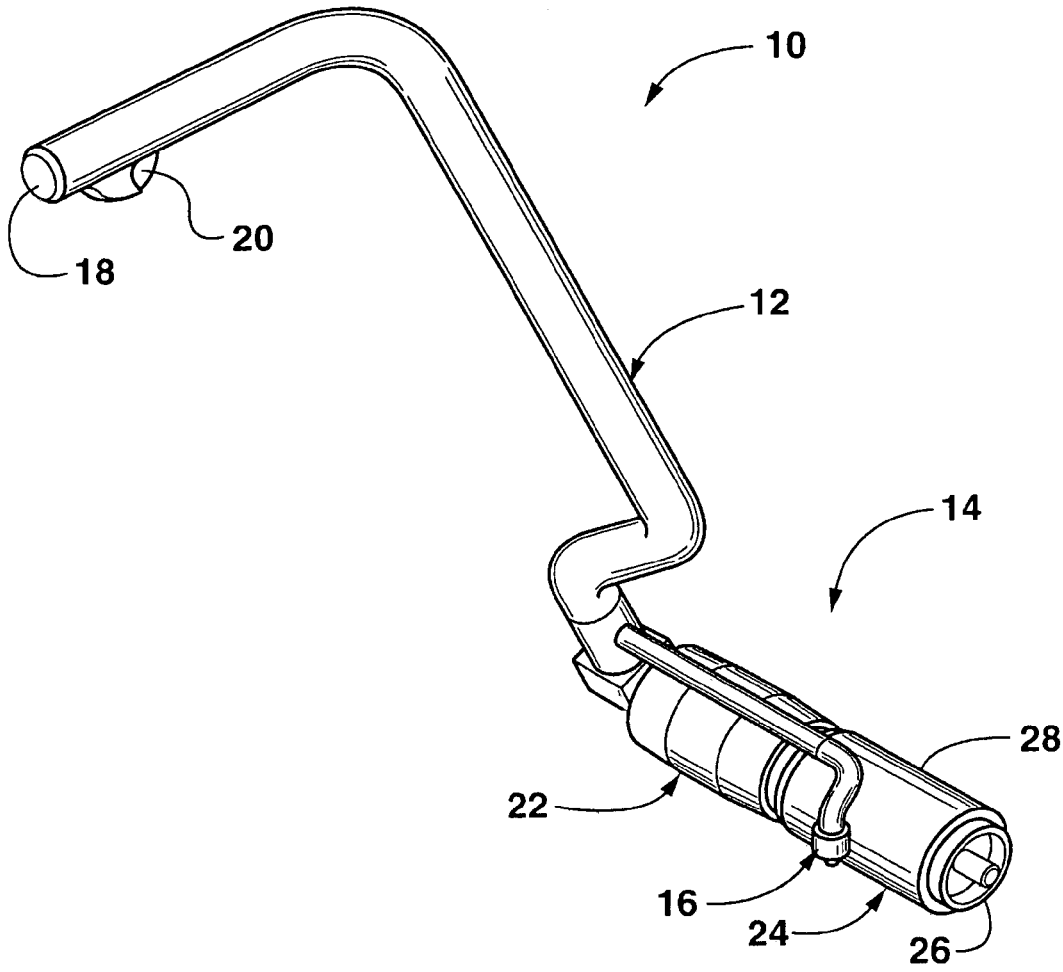
FIG. 1 is a perspective view of one embodiment of a floor scrubbing apparatus made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

The present disclosure is generally directed to a floor scrubbing apparatus that is particularly well suited to removing stains and spills on a carpet. The floor scrubbing apparatus can be a manual device that is configured to deliver a cleaning fluid to the carpet and thereafter withdraw excess fluid along with any stains that may be present on the carpet. In one embodiment, the floor scrubbing apparatus may include a multi-action roller mechanism attached to a relatively long handle. The handle, for instance, can have a length sufficient so that a carpet can be scrubbed while a user is standing so that a user does not have to kneel during the cleaning process and remains remote from any cleaning fluids used.

The roller mechanism on the cleaning device can include a drive roller and a scrub roller. The scrub roller is designed to receive a disposable roller cover. The roller cover, for instance, can be a cylindrical sleeve or can be a sheet of material that is wrapped around the roller. The material placed around the scrub roller is generally highly absorbent and can be designed to exude and draw in excess fluid along with stains. In one embodiment, the material placed around the scrub roller can be textured, such as containing multiple ribs, to facilitate scrubbing.

The floor scrubbing apparatus of the present disclosure can be designed to easily disassemble into multiple pieces for easy storage. The floor scrubbing apparatus can also be designed to include a cleaning fluid dispensing system. For instance, the apparatus can include one or more nozzles that can be designed to emit a cleaning fluid either on the scrub roller or onto a carpet adjacent the scrub roller. In one embodiment, the handle can be hollow and can be designed to receive a cleaning fluid for feeding the cleaning fluid to one or more nozzles. A pump can be included for dispensing the cleaning fluid from the handle through one or more of the nozzles.

Referring to FIG. 1, one embodiment of a floor scrubbing apparatus 10 made generally in accordance with the present disclosure is illustrated. As shown, the floor scrubbing apparatus includes a handle 12 that is attached to a roller arrangement 14. The handle 12 can have any suitable length. In one particular embodiment, for instance, as described above, the handle can be long enough so that a user can clean and scrub a carpet while standing. For instance, in one embodiment, the handle 12 can have a length of at least about 36 inches.

Having a relatively long handle can provide various advantages and benefits. For instance, the handle 12 can provide good leverage on the area of the carpet being cleaned, without a user having to kneel or bend over. A relatively long handle also places the user remote from where the cleaning fluid is applied. In this manner, inhalation of any airborne solvents is minimized.

Figure 3:
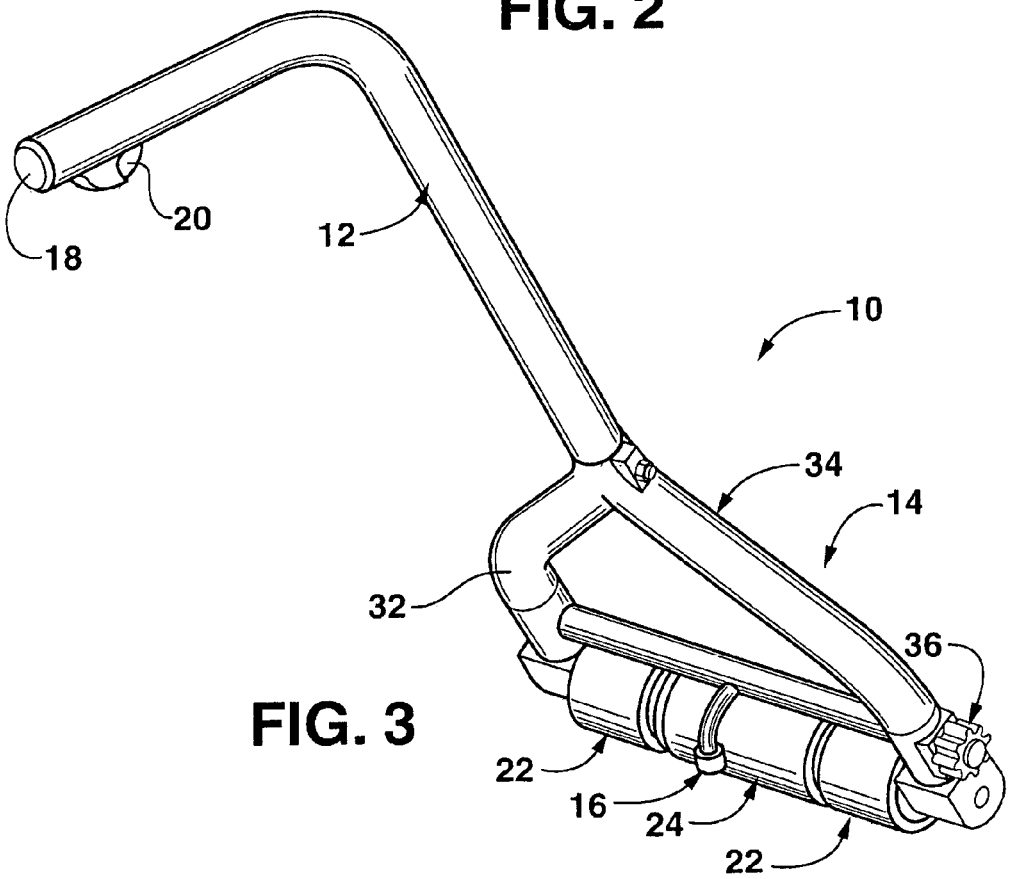
FIG. 3 is a perspective view of still another embodiment of a floor scrubbing apparatus made in accordance with the present disclosure.

The handle 12 can be made from any suitable material. For instance, the handle 12 can be made from a molded plastic or a light metal, such as aluminum. The handle 12 can be constructed from a single piece of material as shown in FIG. 3, or, alternatively, may be made of multiple segments. In one embodiment, for instance, the handle may be made from two or three segments that telescope together for compact storage.

As shown in FIG. 1, the floor scrubbing apparatus 10 can also include, if desired, a cleaning fluid dispensing system for dispensing a cleaning fluid on the roller arrangement 14 or on a carpet adjacent to the roller arrangement. In the embodiment illustrated, the apparatus includes a single nozzle 16. It should be understood, however, that in other embodiments a row of nozzles may be positioned parallel with the roller arrangement if desired.

The nozzle 16 can be placed in communication with a reservoir that is configured to hold a cleaning fluid. The reservoir can be positioned on the handle 12. For instance, in one embodiment, the cleaning fluid can be sold in a plastic container that has a puncturable top. The cleaning fluid can be turned upside down and placed in an adaptor supported by the handle 12. The adaptor can include a puncturing device for puncturing the cleaning fluid and providing fluid communication between the reservoir and the nozzle 16.

Alternatively, as shown in FIG. 1, the reservoir can be contained within the handle 12 itself. For instance, the handle 12 can be hollow and can be configured to receive a cleaning fluid through an open end 18. Once the cleaning fluid is poured into the handle 12, a cap can then be placed over the open end.

In order to dispense a cleaning fluid from the reservoir out the nozzle 16, the apparatus 10 can include a pump mechanism. For instance, in one embodiment, the apparatus 10 can include a trigger operated pump similar to the pumps currently sold with spray bottles. In this regard, the apparatus 10 can include a trigger 20 as shown in FIG. 1.

Alternatively, a battery operated pump may be incorporated into the apparatus 10. In this embodiment, the trigger 20 may be used to turn the pump on and off.

The roller arrangement 14 included with the apparatus 10 includes a drive roller 22 coupled to a scrub roller 24. More particularly, the drive roller 22 is coupled to the scrub roller 24 such that the drive roller drives the scrub roller when the drive roller is rotated. The drive roller 22 serves as a guide roller that traverses the carpet in keeping with a user's forward and backward pushing and pulling of the handle. The scrub roller 24, on the other hand, is a "slave" to the drive roller and is caused to rotate as the drive roller is rotated. The drive roller 22 maintains control over the direction and course of the overall device, while the scrub roller provides friction and disturbance to a carpet. In this manner, as the drive roller 22 is rolled back and forth over a carpet, the scrub roller 24 creates a light scrubbing motion that loosens stains inside the carpet and discourages matting of the carpet pile.

The scrub roller 24 can comprise a mandrel 26 that is configured to receive a disposable scrubbing material 28. The scrubbing material 28, for instance, can comprise a sleeve that fits over the mandrel 26. Alternatively, the scrubbing material 28 can comprise a planar sheet that is wrapped around the mandrel. The scrubbing material is generally any suitable compressible material capable of withstanding the scrubbing motion and absorbing stains as they are removed from the carpet material.

Figure 2:
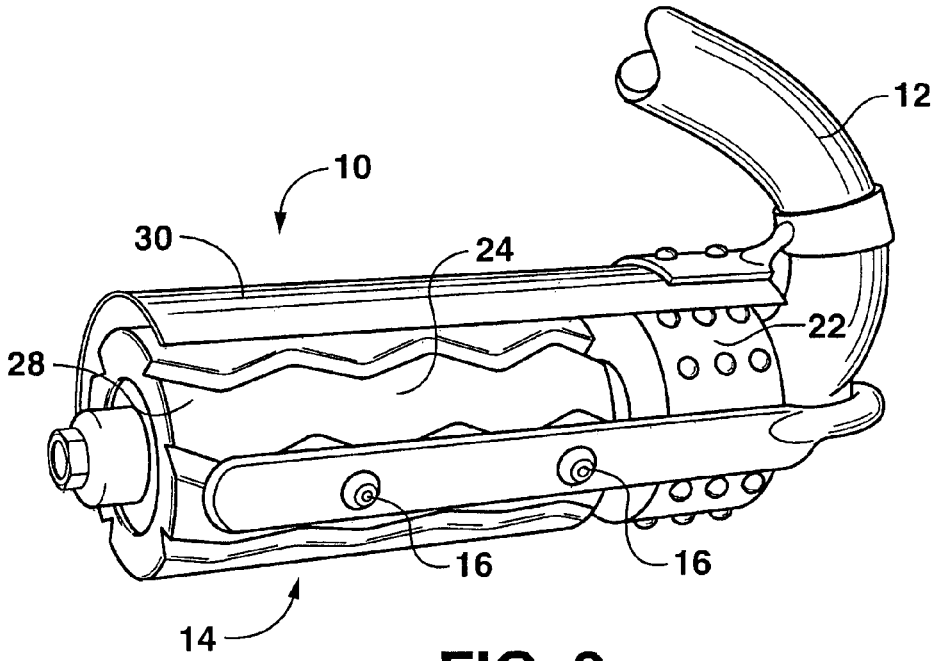
FIG. 2 is a perspective view of another embodiment of a floor scrubbing apparatus made in accordance with the present disclosure.

Referring to FIG. 2, an alternative embodiment of a floor scrubbing apparatus 10 made in accordance with the present disclosure is illustrated. Like reference numerals have been used to indicate similar elements.

As shown, the floor scrubbing apparatus 10 as shown in FIG. 2 is very similar to the embodiment shown in FIG. 1. The floor scrubbing apparatus 10 includes a handle 12 attached to a roller arrangement 14. The roller arrangement 14 includes a drive roller 22 coupled to a scrub roller 24. In this embodiment, the length of the drive roller 22 is relatively small in comparison to the length of the scrub roller 24. For instance, the length of the drive roller 22 can be less than one-half, less than one-third, and even less than one-fourth of the length of the scrub roller 24.

In the embodiment illustrated in FIG. 2, the floor scrubbing apparatus 10 includes two different nozzles 16 instead of a single nozzle as shown in FIG. 1. In addition, the apparatus 10 illustrated in FIG. 2 includes a shield 30 that partially encircles the roller arrangement 14. The shield 30 is to contain the cleaning fluid on the scrub roller 24 as the scrub roller is rotated. In this manner, any cleaning fluid, especially dirty cleaning fluid picked up from the carpet, is not sprayed or splashed on other parts of the carpet. As shown, the shield 30 can encircle the roller arrangement so as to cover at least about 90° of the circumference of the roller arrangement, such as at least about 120°, such as at least about 150°, such as at least about 180° of the roller arrangement.

In the embodiment illustrated in FIG. 2, texture can also be seen on the drive roller 22 and on the scrub roller 24. The drive roller 22, for instance, can be made from a plastic or elastomeric material and can include projections that increase friction between the carpet material and the roller.

The scrub roller 24, on the other hand, can include a scrubbing sleeve 28 that includes ridges. The ridges may facilitate scrubbing of the carpet material.

Referring to FIG. 3, another embodiment of a floor scrubbing apparatus 10 made in accordance with the present disclosure is shown. Again, like reference numerals have been used to indicate similar elements. As shown, the floor scrubbing apparatus 10 includes a handle 12 attached to a roller arrangement 14. The handle 12 can be hollow for receiving a cleaning fluid and can include a trigger 20 for pumping the cleaning fluid out through a nozzle 16.

In this embodiment, the handle 12 branches off into a first tine 32 and a second tine 34. The tines are attached to opposite ends of the roller arrangement. For instance, as shown in FIG. 3, a user actuated securing device 36 may be used to connect and disconnect the handle from the roller arrangement. In the embodiments illustrated in FIGS. 1 and 2, the handle is generally in a cantilevered configuration in that the handle is only attached to one side of the roller arrangement. In FIG. 3, however, the handle 12 is attached to both sides of the roller arrangement 14 which may provide for greater stability.

In the embodiment illustrated in FIG. 3, the roller arrangement includes a scrub roller 24 positioned in between two drive rollers 22. Both or only one of the drive rollers may be coupled to the scrub roller 24 for rotating the scrub roller.

In an alternative embodiment, the drive roller may be positioned in between a pair of outer scrub rollers. The drive roller may also be positioned at one end, while the other end contains a pair of scrub rollers. It should be understood that the cleaning fluid dispensing system is optional for use with respect to the floor scrubbing apparatus 10. For instance, in another embodiment, the scrubbing material 28 positioned on the scrub roller 24 can be prewetted with a cleaning fluid that delivers the cleaning fluid to the carpet and then draws in excess fluid during the scrubbing process.

In still another embodiment, the floor scrubbing apparatus 10 can include two scrubbing rollers in which one scrubbing roller is dry and the other scrubbing roller is prewetted with a cleaning fluid. The prewetted scrub roller can apply a cleaning fluid to the carpet, while the dry scrub roller can be used to absorb the cleaning fluid once cleaning is complete.

As described above, the drive roller 22 is coupled to the scrub roller 24 so as to rotate the scrub roller when the drive roller is rotated. In general, any suitable gear arrangement may be included in the apparatus in order to couple the drive roller to the scrub roller. In one embodiment, the gear arrangement may be configured so that the drive roller drives the scrub roller at a rotational speed that is greater than the speed at which the drive roller itself is rotated. For instance, in one embodiment, the gear arrangement may be configured to rotate the scrub roller at a speed that is at least 1.5 times greater, at least 2 times greater, at least 2.5 times greater or even at least 3 times greater than the speed at which the drive roller is rotated. The speed differential between drive and scrub rollers creates a scrubbing action that assists in the cleaning process.

Figures 4, 5:
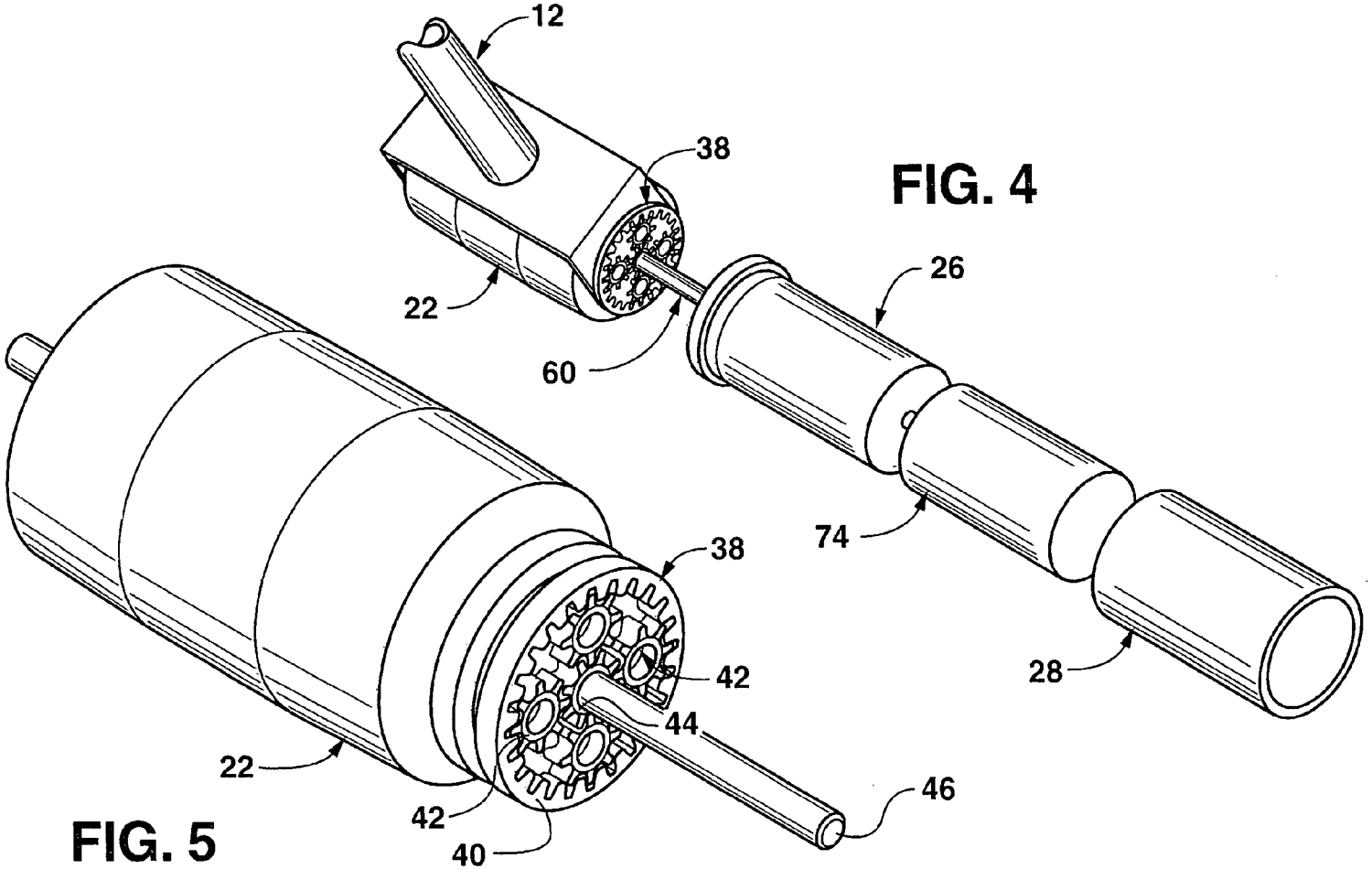
FIG. 4 is a perspective view of another embodiment of a floor scrubbing apparatus made in accordance with the present disclosure.
FIG. 5 is a perspective view of a drive roller as shown in the embodiment of FIG. 4.
Figure 6:
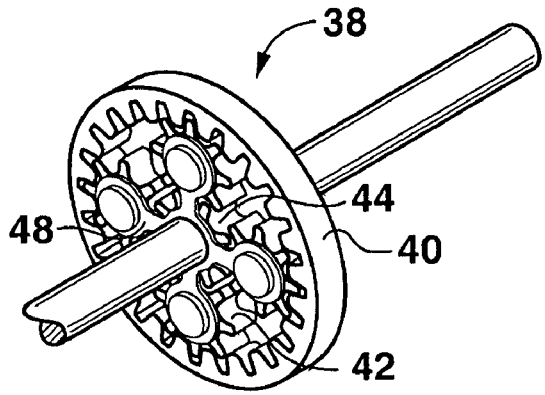
FIG. 6 is a perspective view of one embodiment of a gear arrangement that may be used in accordance with the present disclosure.

For instance, referring to FIGS. 4, 5 and 6, one embodiment of a gear arrangement 38 that may be used in accordance with the present disclosure is illustrated. In this embodiment, for instance, the gear arrangement 38 comprises a planetary gear set. It should be understood, however, that any suitable gear arrangement may be used.

As shown particularly in FIG. 5, the gear arrangement 38 includes a stationary ring gear 40 that is fixed to a frame that does not rotate on the drive roller. The gear arrangement 38 further includes a sun gear 44 and a plurality of planet gears 42 that are positioned in between the ring gear 40 and the sun gear 44.

As shown in FIG. 6, the planet gears 42 are attached to a coupling device 48 that is connected to or otherwise associated with the drive roller 22. When the drive roller 22 rotates, the coupling device 48 forces the planet gears 42 to rotate as they engage and walk around the ring gear 40. The planet gears 42, in turn, cause the sun gear 44 to rotate. As shown particularly in FIG. 5, the sun gear 44 is coupled to a shaft 46. The shaft 46 then causes the scrub roller 24 to rotate.

As described above, the gear arrangement 38 is configured to drive the scrub roller 24 at a speed faster than the speed at which the drive roller is rotated. This overdrive action causes the scrub roller surface to move faster than the speed at which a user moves the drive roller across a carpet. The relative speed difference between the scrub roller and the carpet causes a scrubbing action that is very efficient at cleaning the carpet and absorbing cleaning fluid, but also does so without harming the carpet fibers.

Figure 7:
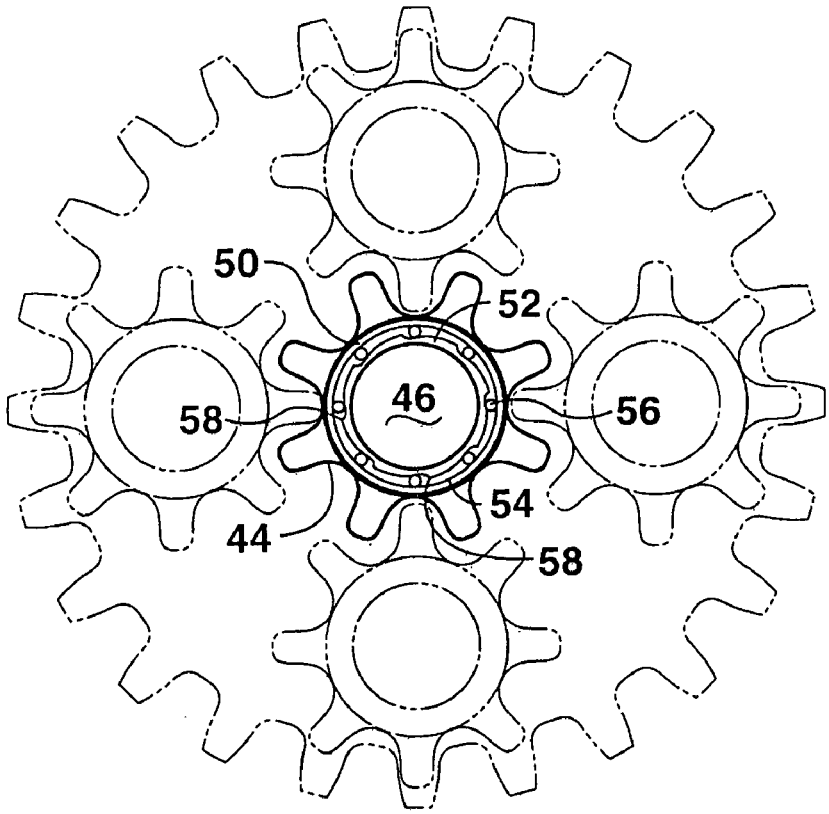
FIG. 7 is a side view of one embodiment of a clutch device that may be incorporated into the floor scrubbing apparatus of the present disclosure.

In the embodiment of the gear arrangement 38 as shown in FIG. 5, the scrub roller is rotated forward when the drive roller is rotated forward and the scrub roller is rotated backwards when the drive roller is rotated backwards. In an alternative embodiment, however, the gear arrangement 38 may be configured such that the scrub roller only rotates forward and is only driven when the drive roller is pushed forward or vice versus. For instance, referring to FIG. 7, in one embodiment, a clutch device 50 may be incorporated into the gear arrangement 38. The clutch device 50 only allows the shaft 46 to be driven in one direction.

As shown, the clutch device 50 includes an inner collar 52, an outer collar 54, and a plurality of bearing elements 56 positioned in between the inner collar 52 and the outer collar 54. The inner collar 52, which may be integral with the shaft 46, includes a plurality of bearing engagement members 58. When the sun gear 44 is rotated clockwise in the figure, the bearing elements 56 are contacted and engaged by the bearing engagement members 58. The bearing engagement members 58 prevent the bearing elements 56 from further rotating in between the inner collar 52 and the outer collar 54. Thus, when the sun gear 44 is rotated clockwise, the shaft 46 is rotated clockwise.

When the sun gear 44 is rotated counterclockwise, on the other hand, the bearing elements 56 are not engaged by the bearing engagement members 58. Thus, the bearing elements freely move in between the inner collar 52 and the outer collar 54. Thus, when the sun gear 44 is rotated in a counterclockwise direction, the shaft 46 is not engaged.

In this configuration, the scrub roller can be configured only to be driven on the forward stroke of the drive roller. On the back stroke of the drive roller, on the other hand, the scrub roller can be freewheeling. It should be understood, however, that the freewheeling direction is determined by the orientation of the clutch device. If desired, the clutch device can be oriented so that the shaft 46 is only driven on a backward motion of the drive roller.

Incorporation of the clutch device 50 into the floor scrubbing apparatus 10 may provide various advantages and benefits. For instance, use of the clutch device 50 may make it easier to use the floor scrubbing apparatus. In particular, when the floor scrubbing apparatus is pushed in a forward direction, the scrub roller is rotated and set in motion. Due to the inertia of the scrub roller, in some embodiments, it may be harder to move the floor scrubbing apparatus back and forth and overcome the momentum of the scrub roller as the drive roller changes directions. When using the clutch device, however, the inertia of the scrub roller does not have to be overcome when the direction of the drive roller is changed. It should be understood, however, that in other embodiments, it may be desirable to have the scrub roller change directions. For instance, having the scrub roller change directions may provide for better scrubbing action against a carpet material.

As described above, the scrub roller 24 is driven and rotated by the drive roller 22. In one alternative embodiment, in addition to being rotated, the scrub roller can also move in a side-to-side motion if desired. In this embodiment, a shifting device may be incorporated into the gear arrangement and the scrub roller for causing the scrub roller to move back and forth as the scrub roller is rotated.

Figure 8:
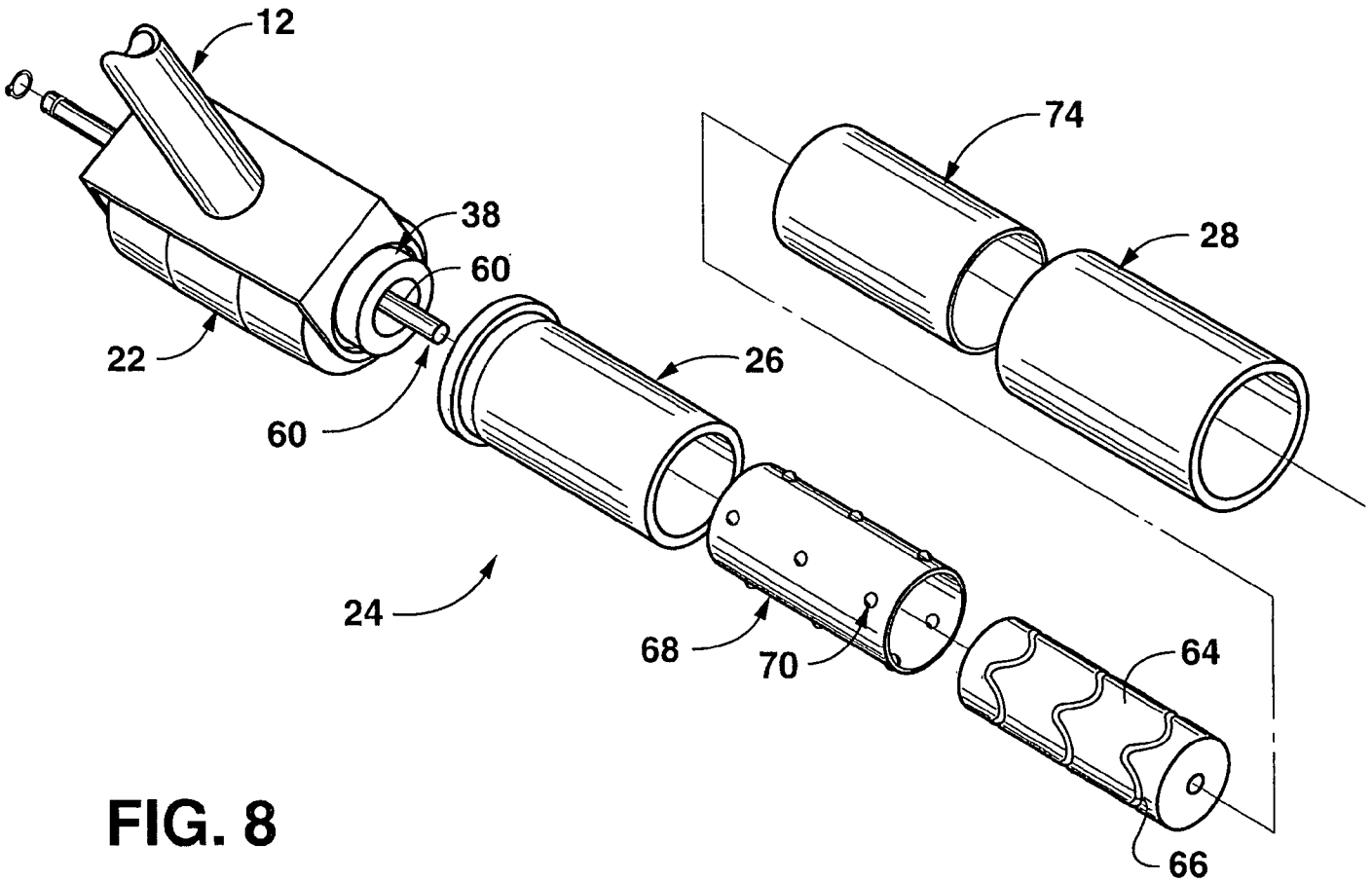
FIG. 8 is a perspective view of still another embodiment of a floor scrubbing apparatus made in accordance with the present disclosure.
Figure 9:
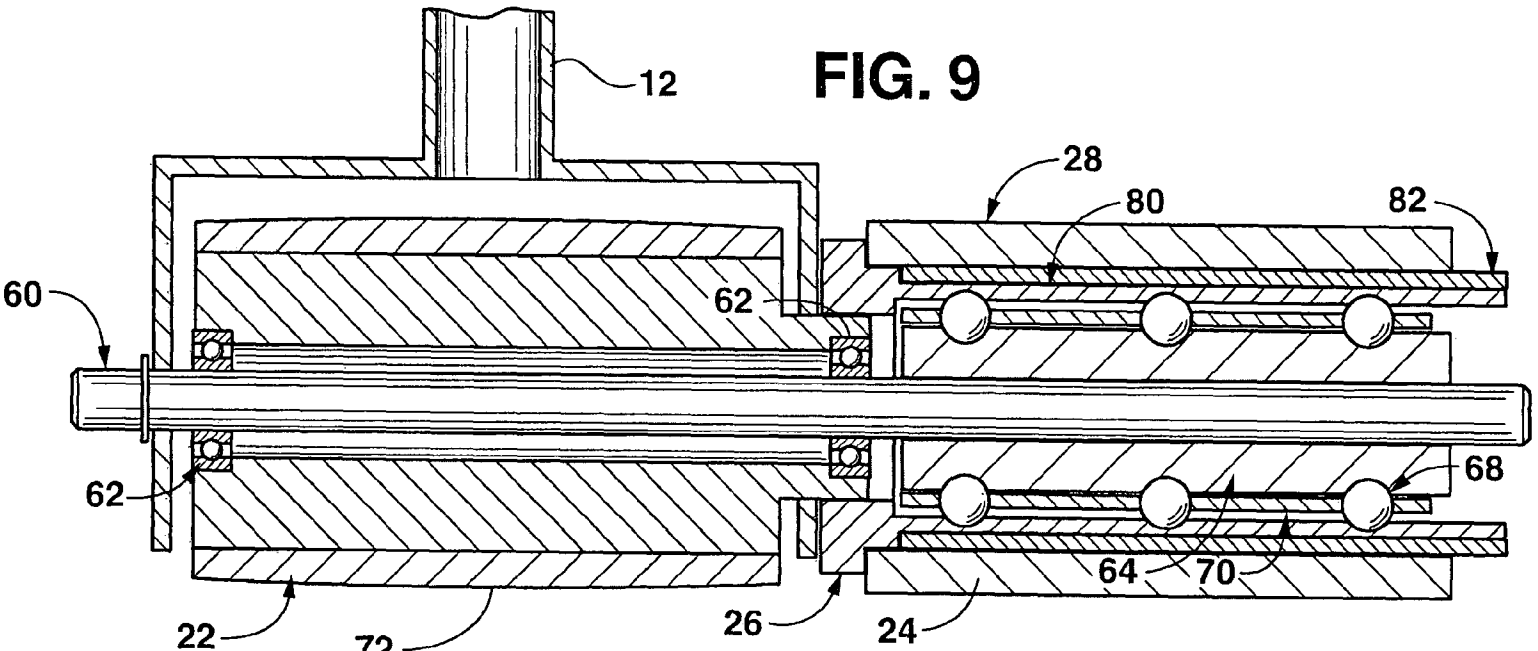
FIG. 9 is a cross-sectional view of another embodiment of a floor scrubbing apparatus made in accordance with the present disclosure.

For instance, one embodiment of a shifting device that may be used in accordance with the present disclosure is illustrated in FIGS. 8 and 9. Like reference numerals have been used to indicate similar elements.

As shown in FIGS. 8 and 9, the floor scrubbing apparatus includes a handle 12 attached around a drive roller 22. The drive roller 22 is coupled to a scrub roller 24. In particular, a gear arrangement 38 is used to drive the scrub roller 24 as the drive roller is rotated.

As shown in FIG. 9, a stationary center shaft 60 extends through both the drive roller 22 and the scrub roller 24. The drive roller 22 includes first and second sets of bearings 62 that allows the drive roller to rotate around the shaft 60. The scrub roller 24 further includes a second stationary shaft 64. As shown particularly in FIG. 8, the stationary shaft 64 defines one or more channels 66. The channel 66 can extend only partially around the circumference of the shaft or may extend over the entire circumference. The channel 66 has at least one S-like curve.

The scrub roller 24 further includes a carrier 70 that contains a plurality of projection members 68. The projection members may be, for instance, ball bearings. The projection members 68 are contained within the channel 66 located on the stationary shaft 64. The carrier 70 and the projecting member 68 are contained within the scrub roller mandrel 26.

When the scrub roller 26 is rotated by the drive roller 22, the projecting members follow the path of the channels 66 defined by the shaft 64. More particularly, the projecting members 68 follow the S-like curves which causes the mandrel 26 of the scrub roller to move back and forth as the mandrel rotates. In this manner, a side-to-side scrubbing motion is created between the scrubbing material 28 and a carpet surface. The side-to-side motion enhances carpet cleaning and the ability of the apparatus to carry away dirt and cleaning fluid.

As shown in FIG. 9, in one embodiment, the drive roller 22 can also include a crown-shaped surface 72. The benefit of the crown-shaped surface 72 is that it provides a relatively large surface area for contact with a floor for the purposes of drive traction. The crown-shaped surface 72 can also allow for adjustability in the contact pressure between the scrub roller 24 and a carpet material. In particular, due to the presence of the crown-shaped surface 72, a user can angle the handle 12 of the floor scrubbing apparatus as appropriate to increase or decrease contact pressure between the scrub roller 24 and a carpet.

More particularly, the crown-shaped surface 72 can include a largest diameter that tapers to a smallest diameter. In the embodiment illustrated in FIG. 9, for instance, the drive roller 22 includes a middle portion that has a largest diameter. The middle portion then tapers gradually to each of the end portions. Alternatively, the largest diameter of the drive roller may be positioned elsewhere and tapers accordingly to one or more other areas.

The manner in which the scrubbing material 28 is held on the scrub roller 24 can vary depending upon the particular application. Also, the scrubbing material 28 can be made from many different types of materials and can come in various forms. In one embodiment, as shown in FIGS. 4 and 8, the scrubbing material 28 comprises a sleeve in the shape of a cylinder that is slid onto the scrub roller 24. In this embodiment, the scrubbing material 28 can be made from any liquid absorbent compressible material. For instance, the scrubbing material may comprise a synthetic sponge-like material or may comprise multiple layers of liquid absorbent sheets. For instance, the multiple layers may comprise coform webs, meltblown webs, spunbond webs, hydroentangled webs, and the like.

In the embodiments illustrated in FIGS. 4 and 8, the scrubbing material 28 is placed over an inflatable bladder 74. As shown, the inflatable bladder 74 is positioned in between the mandrel 26 and the scrubbing materials 28. The inflatable bladder 74 is for holding the scrubbing material 28 into place.

For instance, the inflatable bladder 74 can be fixed to the scrub mandrel 26. The scrubbing sleeve 28 is then placed over the inflatable bladder 74. The bladder is then inflated which locks the scrubbing material 28 into place. The inflatable bladder 74, for instance, may be inflated with a simple pump mechanism that is positioned on one side of the bladder. In this embodiment, the clearance between the inflatable bladder 74 and the mandrel on one side and the scrubbing material on the opposite side can be very small, thus requiring little air volume to hold the scrubbing material in place.

Figure 11:
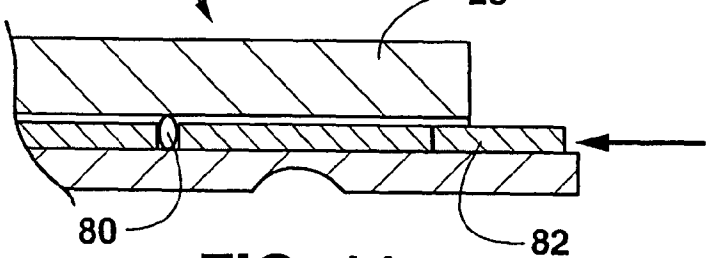
FIGS. 10 and 11 are cross-sectional views of one embodiment of a securing device for securing a scrubbing sleeve to the floor scrubbing apparatus of the present disclosure.
Figure 10:
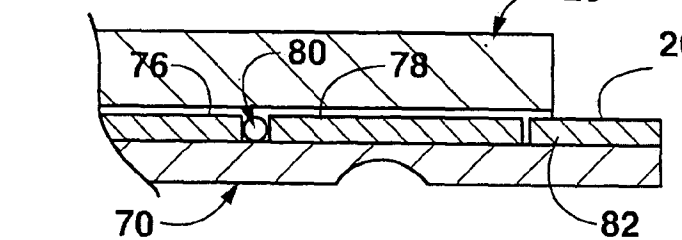

An alternative embodiment of a method for holding the scrubbing material 28 in place is shown in FIGS. 9, 10 and 11. In this embodiment, the mandrel 26 of the scrub roller 24 is comprised of multiple sections. For instance, as shown in FIG. 10, the mandrel 26 can include a first section 76 and a second section 78. Positioned in between the first section 76 and the second section 78 is a gasket or O-ring 80. The mandrel 26 is also placed in communication with a collar 82 that can be, for instance, a threaded collar.

As shown particularly in FIGS. 10 and 11, the threaded collar 82 may be used to force the first section 76 and the second section 78 of the mandrel 26 together causing the gasket 80 to distort and become oblong in shape. The gasket 80 is then forced against the scrubbing material 28 for maintaining the scrubbing material in place.

In addition to the above, it should also be understood, that in an alternative embodiment, the sleeve of scrubbing material 28 may simply form a tension fit on the mandrel 26. For instance, in one embodiment, the sleeve of scrubbing material 28 may be extensible, and even elastic. In this embodiment, the sleeve can be stretched over the mandrel and then retracted into position.

As described above, in addition to a sleeve of material, the scrubbing material 28 can also comprise a sheet of material that is wrapped around the mandrel 26 of the scrub roller 24. The sheet of scrubbing material may comprise, for instance, any suitable liquid absorbent material capable of withstanding the scrubbing motion of the apparatus. For instance, the sheet of scrubbing material may comprise a single layer of material or may comprise a laminate. Materials that may be used to construct the sheet include meltblown webs, coform webs, hydroentangled webs, bonded carded webs, scrim materials, woven materials, and the like.

Figure 12:
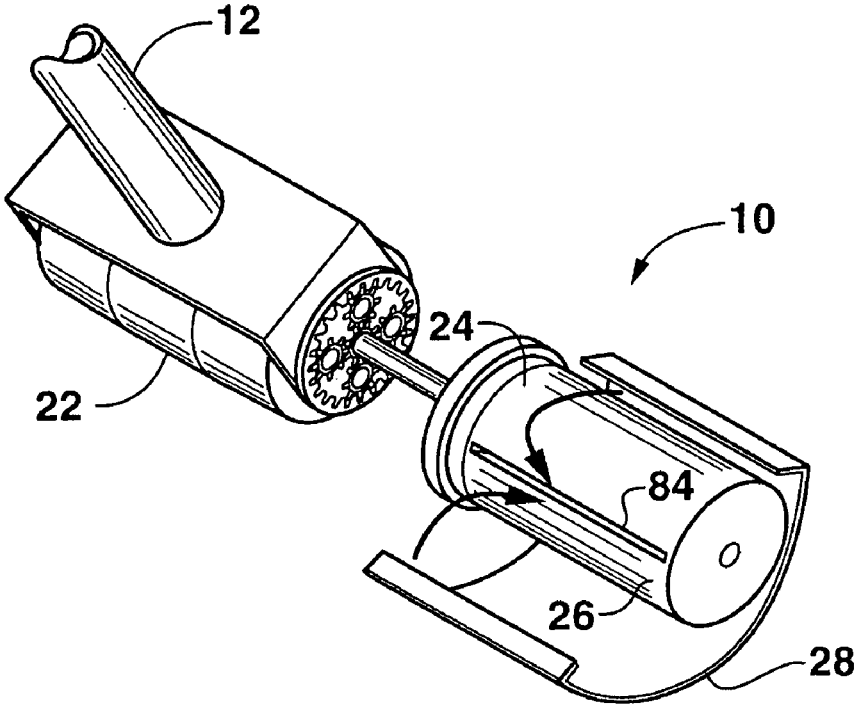
FIG. 12 is a perspective view of still another embodiment of a floor scrubbing apparatus made in accordance with the present disclosure.

The sheet of scrubbing material may be attached to the mandrel 26 using any suitable technique. For instance, as shown in FIG. 12, the mandrel 26 of the scrub roller 24 may define a slot 84 that is configured to receive opposite ends of the scrubbing sheet material 28. If desired, once the ends are inserted into the slot 84, a collar can be used to tighten the mandrel together to hold the scrubbing material in place.

Figure 13:
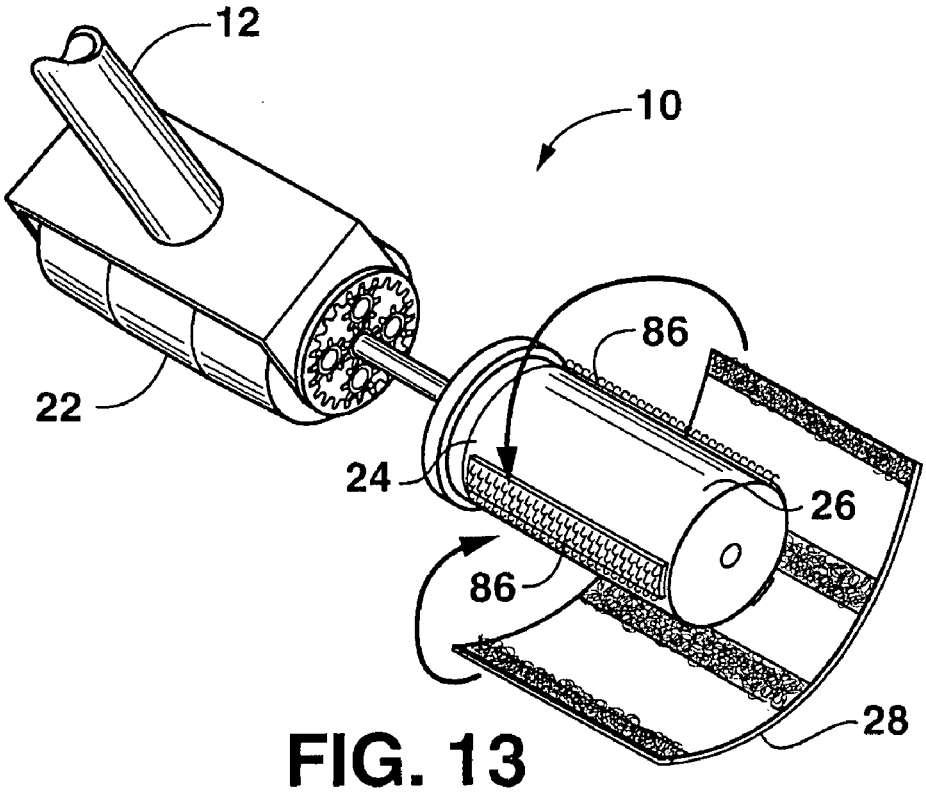
FIG. 13 is still another perspective view of a floor scrubbing apparatus made in accordance with the present disclosure.

Referring to FIG. 13, still another embodiment of a method for maintaining a sheet of scrubbing material 28 in place is illustrated. In this embodiment, the mandrel 26 of the scrub roller 24 includes one or more attachment devices 86 for the scrubbing material. The attachment devices may comprise, for instance, a hook material for forming a hook and loop attachment with the scrubbing material.

In the embodiment illustrated in FIG. 13, discrete areas of hook material 86 are positioned on the mandrel 26. Alternatively, the entire surface area of the mandrel may be covered with the hook material. In order to attach to the scrubbing material, the hook material may inherently form a bond with the scrubbing material or the scrubbing material may include corresponding loop material areas attached to the scrubbing material as shown in FIG. 13.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A floor scrubbing apparatus comprising:

a handle;

a rotating roller arrangement attached to the handle, the roller arrangement including a drive roller in operative association with a scrub roller, the drive roller and scrub roller being positioned substantially along a common axis; and a gear arrangement connecting the drive roller to the scrub roller, the gear arrangement causing the scrub roller to rotate when the drive roller is rotated, the gear arrangement being further configured to rotate the scrub roller at a faster rate than the drive roller;

at least one nozzle positioned to emit a cleaning fluid on or near the scrub roller;

a trigger actuated pump in fluid communication with the nozzle, the pump being configured to pump the cleaning fluid through the nozzle; and wherein the scrub roller comprises a mandrel adapted to receive a scrubbing sleeve, the scrubbing sleeve comprising a liquid absorbent and compressible material.

2. A floor scrubbing apparatus as defined in claim 1, wherein the gear arrangement comprises a planetary gear set, the planetary gear set comprising a stationary ring gear, a sun gear, and a plurality of planet gears positioned in between the sun gear and the ring gear, the planet gears rotating around the ring gear as the drive roller is rotated causing the sun gear to rotate, the sun gear, in turn, causing the scrub roller to rotate.

3. A floor scrubbing apparatus as defined in claim 1, wherein the gear arrangement is in communication with a clutch device that only permits the scrub roller to rotate when the drive roller is rotating in a single and preselected direction.

4. A floor scrubbing apparatus as defined in claim 3, wherein the clutch device comprises an inner collar that is in communication with the scrub roller, the inner collar defining a plurality of bearing engagement members, the clutch device further comprising a plurality of bearing elements positioned along an outer circumference of the inner collar, the bearing elements being positioned between the inner collar and an outer collar that is rotated by the gear arrangement, and wherein, when the outer collar is rotated in a first direction, the bearing elements engage the bearing engagement members causing the inner collar to rotate, and, when the outer collar is rotated in a second and opposite direction, the bearing elements travel along the circumference of the inner collar without rotating.

5. A floor scrubbing apparatus as defined in claim 1, further comprising a shield member that partially encircles the scrub roller.

6. A floor scrubbing apparatus as defined in claim 1, wherein the drive roller includes a largest diameter that tapers to a smallest diameter.

7. A floor scrubbing apparatus as defined in claim 1, wherein the drive roller includes a middle portion positioned in between a first end portion and a second end portion, the middle portion having a diameter greater than the diameter of the first and second end portions, the middle portion gradually tapering from the middle portion to each of the end portions.

8. A floor scrubbing apparatus as defined in claim 1, wherein the scrub roller comprises a mandrel covered by a compressible layer.

9. A floor scrubbing apparatus as defined in claim 1, wherein the scrub roller further comprises an inflatable bladder positioned in between the mandrel and the scrubbing sleeve, the inflatable bladder being configured to hold the scrubbing sleeve in place when inflated.

10. A floor scrubbing apparatus comprising:

a handle; and a rotating roller arrangement attached to the handle, the roller arrangement including a drive roller in operative association with a scrub roller, the drive roller and the scrub roller being positioned substantially along a common axis and being coupled together such that the scrub roller is driven by the drive roller when the drive roller is rotated, the drive roller having a first end and a second end and including at least one tapered surface that gradually tapers from a greatest diameter to a smaller diameter, the smaller diameter being generally located at the first end;

wherein the scrub roller comprises a mandrel adapted to receive a scrubbing sleeve, the scrubbing sleeve comprising a liquid absorbent and compressible material.

11. A floor scrubbing apparatus as defined in claim 10, wherein the drive roller includes a middle portion positioned between the first end and the second end, the greatest diameter being located in the middle portion, the drive roller including a first tapered surface that gradually tapers from the middle portion to the first end and a second tapered surface that gradually tapers from the middle portion to the second end.

12. A floor scrubbing apparatus as defined in claim 10, further comprising a gear arrangement connecting the drive roller to the scrub roller, the gear arrangement being configured to rotate the scrub roller at a faster rate than the drive roller.

13. A floor scrubbing apparatus as defined in claim 10, wherein the gear arrangement is in communication with a clutch device that only permits the scrub roller to rotate when the drive roller is rotating in a single and preselected direction.

14. A floor scrubbing apparatus as defined in claim 1, further comprising a reservoir in communication with the at least one nozzle, the reservoir for holding the cleaning fluid.

15. A floor scrubbing apparatus as defined in claim 14, wherein the handle defines an internal compartment that comprises the reservoir.

16. A floor scrubbing apparatus as defined in claim 14, wherein the reservoir is a container that is separable from the handle.

* * * * *